United States Patent [19]

Konrath et al.

[11] 4,378,002

[45] Mar. 29, 1983

[54] FUEL INJECTION PUMP FOR INTERNAL COMBUSTION ENGINES

[75] Inventors: Karl Konrath, Ludwigsburg; Helmut Laufer, Stuttgart, both of Fed. Rep. of Germany

[73] Assignee: Robert Bosch GmbH, Stuttgart, Fed. Rep. of Germany

[21] Appl. No.: 167,624

[22] Filed: Jul. 11, 1980

[30] Foreign Application Priority Data

Aug. 7, 1979 [DE] Fed. Rep. of Germany ..... 2931944

[51] Int. Cl.[3] ..... F02M 59/32

[52] U.S. Cl. ..... 123/502; 123/179 L

[58] Field of Search ..... 123/502, 501, 500, 179 L

[56] References Cited

U.S. PATENT DOCUMENTS

| | | | |
|---|---|---|---|
| 4,100,903 | 7/1978 | Roosa | 123/502 |
| 4,273,090 | 6/1981 | Höfer | 123/502 |
| 4,318,382 | 3/1982 | Eheim | 123/502 |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump having elements for adjustment of the injection adjusting piston over a predetermined rpm range, advancing the adjustment toward "early" during cold starting and not further advanced with increasing rpm.

13 Claims, 8 Drawing Figures

FIG.1
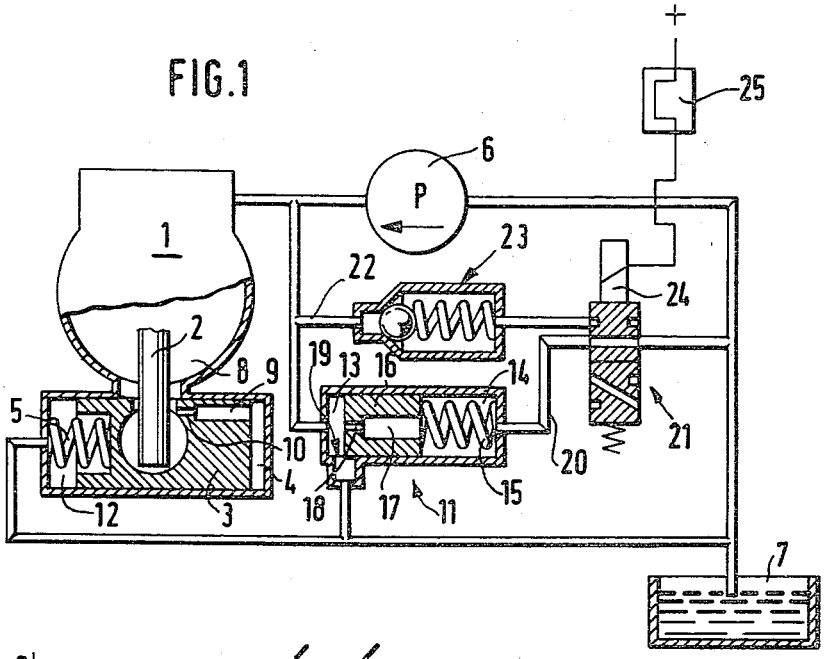
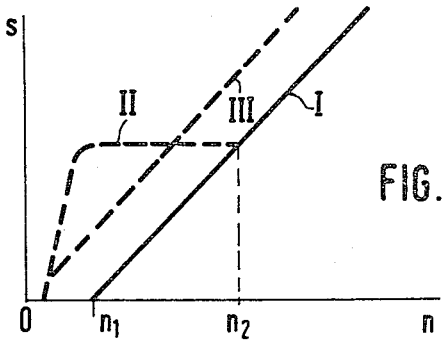
FIG. 2
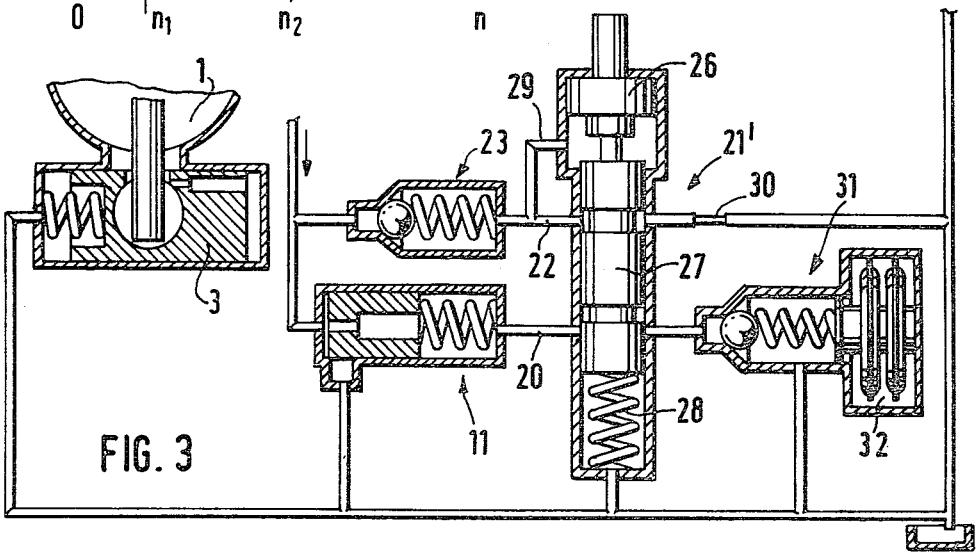
FIG. 3

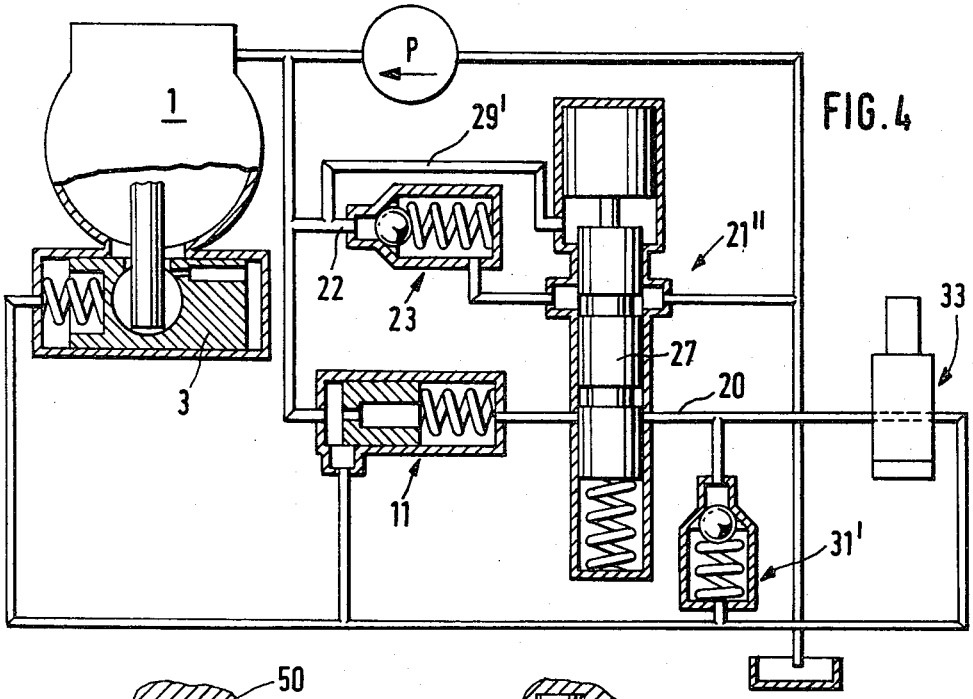
FIG.4
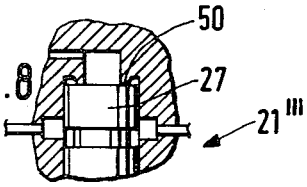
FIG.8
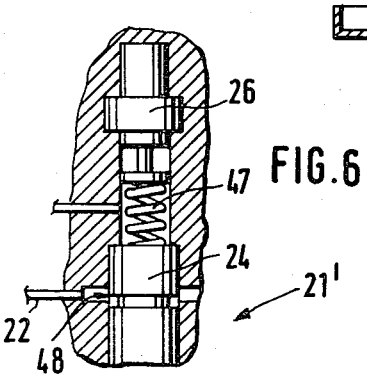
FIG.6
FIG.5
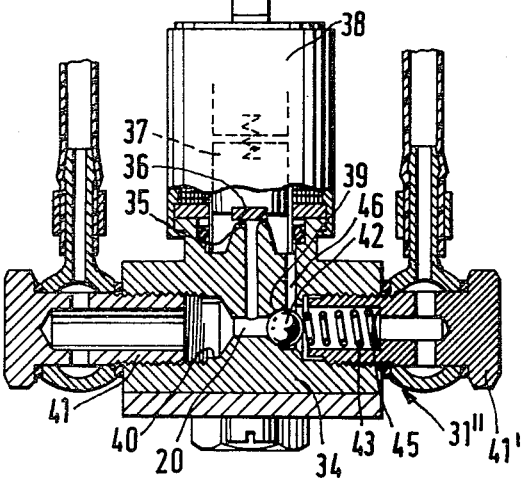
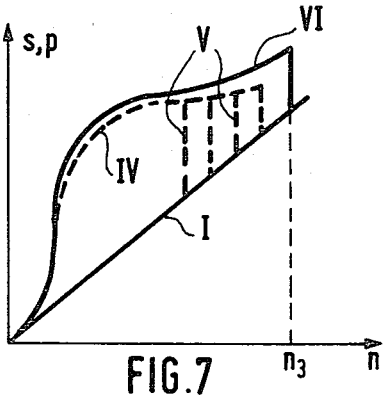
FIG.7

FUEL INJECTION PUMP FOR INTERNAL COMBUSTION ENGINES

BRIEF SUMMARY OF THE INVENTION

The invention relates to a fuel injection pump having elements for adjustment of the injection adjusting piston over a predetermined rpm range, advancing the adjustment toward "early" during cold starting and not further advanced with increasing rpm.

BACKGROUND OF THE INVENTION

In a known fuel injection pump of this kind, a controlled pressure maintenance valve is disposed in the outflow conduit of the restoring chamber. As a result, the pressure also varies with the rpm, variously determined by the function of the pressure control valve per se as well as by the additional intervention of the intervening pressure maintenance valve. The pressure thus varies in accordance with the rpm, but to a variable degree depending upon the functioning of the controlled pressure maintenance valve. For many engines, however, it is desirable for a certain adjustment of the injection adjusting piston to be made, for instance toward "early", and that this adjustment then remains constant over the rpm, and in particular over a certain rpm range, that is, this adjustment does not vary with the rpm, or, if it does vary, then it varies only in an insignificant manner.

OBJECT AND SUMMARY OF THE INVENTION

The fuel injection pump according to the invention has as an object and advantage of providing an adjustment of the injection adjusting piston that is fixed over a predetermined rpm range. An adjustment toward "early", which is particularly advantageous during cold starting, is accordingly not further amplified in the direction of "early" with increasing rpm. Engine running and the exhaust emissions are thus substantially improved. As disclosed, the control valve disposed in the outflow conduit of the restoring chamber can advantageously act at the same time to control the relief conduit. The other control means disclosed in the description of the preferred embodiments also have substantial advantages.

The invention will be better understood, and further objects and advantages thereof will become more apparent from the ensuing detailed description of preferred embodiments taken in conjunction with the drawings.

BRIEF DESCRIPTION OF THE DRAWINGS

FIGS. 1, 3 and 4 are schematic illustrations and representations of switching;

FIGS. 2 and 7 are plot diagrams of the relationships as shown;

FIG. 5 shows a constructive detail of FIG. 4; and

FIGS. 6 and 8 show triggering details of the multiple-position valve controlling the outflow conduit and the relief conduit.

DESCRIPTION OF THE PREFERRED EMBODIMENTS

Referring now to the drawings, there is shown an adjusting piston 3 engaging a cam drive of a fuel injection pump 1 via a pin 2 in order to adjust the instant of onset of injection. The adjusting piston 3 is displaceable by a pressure fluid located in a work chamber 4 against the force of a restoring spring 5. The farther the piston is displaced in the direction of the spring 5, the more the instant of injection is displaced toward "early" relative to the top dead center of the engine piston. A supply pump 6 aspirates fuel from a fuel container 7 and supplies it to a suction chamber 8 of the injection pump 1, from which an actual fuel injection pump, not shown in detail, is supplied with fuel and which communicates via a bore 9 in the adjusting piston 3 with the work chamber 4. This bore 9 has a throttle restriction 10. The supply pressure of the supply pump 6 and thus the pressure in the suction chamber 8 are controlled in accordance with rpm via a pressure control valve 11, the pressure increasing proportionally with increasing rpm. This rpm-dependent pressure also prevails in the work chamber 4, so that with increasing rpm and thus increasing pressure the injection adjusting piston 3 is displaced toward "early" counter to the force of the spring 5. The chamber 12 enclosing the spring 5 is relieved of pressure toward the fuel container 7.

In the plot diagram shown in FIG. 2, the stroke "s" of the adjusting piston 3 is plotted on the ordinate and the rpm "n" is plotted on the abscissa. The curve for the injection adjustment is plotted as indicated by I for normal operation of the pressure control valve 11; that is, for an adjustment toward "early" which is proportional to rpm. The adjustment begins at an rpm $n_1$.

The pressure control valve 11 has a pressure chamber 13 and a restoring chamber 14, which are separated by a control piston 16 subject to the force of a restoring spring 15. The pressure chamber 13 and the restoring chamber 14 have a throttle connection in the form of a bore 17 in the control piston 16. This bore 17 in corresponding fashion has a throttle 18. An outflow cross section 19 of the pressure control valve 11 is determined by the control piston 16. An outflow channel 20 branches off from the restoring chamber 14 of the pressure control valve 11 and is controllable by a multiple-position valve 21.

Parallel to the pressure control valve 11, a relief conduit 22 branches off from the compression side of the supply pump 6, and is likewise controlled by the multiple-position valve 21 and has disposed in it a pressure maintenance valve 23. Depending upon the switching position of the multiple-position valve 21, the supply quantity of the supply pump 6 not consumed by the fuel injection pump flows via one of the valves 11 or 23 for the purpose of pressure control. When the pressure maintenance valve 23 has its opening pressure set lower than the pressure control valve 11, an adjustment toward "late" can be effected; in like manner, when it is set higher, an adjustment toward "early" can be effected. In each case, however, the adjustment should be considered as taking place in abrupt intervals; that is, a predetermined pressure is initiated independently of the rpm. In the plot diagram shown in FIG. 2, the broken-line curve II indicates the switching position of the multiple-position valve 21 for which the pressure control valve 11 is closed and the pressure maintenance valve 23 is opened. In accordance with the course of the curve II, the constant opening pressure of the pressure maintenance valve 23, at relatively low rpm up to rpm $n_2$, is greater than the corresponding opening pressure of the pressure control valve 11.

In the first exemplary embodiment shown in FIG. 1, the multiple-position valve 21 is embodied as a magnetic valve, in which a magnet 24 is triggered by a control device 25. In the illustrated normal position, the pressure maintenance valve 23 is blocked and the pressure control valve 11 is functioning. The quantity of fuel not consumed by the internal combustion engine and supplied by the supply pump 6 flows via the outflow cross section 19 and the connection 17 and the outflow channel 20 and flows out. As soon as the multiple-position valve 21 has been switched over by the magnet 24, for instance during starting of the cold engine or under other forms of control, the outflow channel 20 is blocked and the relief channel 22 is opened. By means of blocking the outflow channel 20, a pressure builds up via the throttle connection 17 and the restoring chamber 14 which reinforces the force of the spring 15 and displaces the control piston 16 toward the left in FIG. 1 so that the pressure control valve 11 is blocked. Because of the pressure which then increases, the pressure maintenance valve 23 is opened and the fuel flows in accordance with curve II toward the fuel container 7 or toward the suction side of the supply pump 6.

However, it is also conceivable that the multiple-position valve 21 may control solely the outflow channel 20, to the extent that the pressure maintenance valve 23 has a higher opening pressure for an adjustment toward "early", or that the multiple-position valve 21 may control solely the relief channel 22, to the extent that the pressure of the pressure maintenance valve 23, for the purpose of adjustment toward "late", is very low, and in any case lower than the control pressure, is set in the pressure control valve 11. A system of this kind will be considered as the second and third exemplary embodiments, respectively. In the fourth exemplary embodiment shown in FIG. 3, the multiple-position valve 21' is triggered via an expansible-substance governor 26, which actuates a control slide 27 counter to the force of a restoring spring 28. The expansible-substance governor 26 can, in turn, be heated either by the coolant of the engine or by electrical means. In the drawing, the slide 27 assumes a position in which it opens the relief channel 22. The course of the pressure corresponds to curve II in FIG. 2. In order to assure that beyond a predetermined rpm, for instance the rpm $n_2$, the slide 27 is displaced into the other switching position, in which the pressure maintenance valve 23 is blocked and the pressure control valve 11 is opened, a control line 29 branches off from the relief channel 22 upstream of the multiple-position valve 21', and by way of this control line 29 the fuel pressure prevailing in the line 22 is delivered to the end face of the slide 27, in order to displace it accordingly. In order for a corresponding pressure to be created in the relief line 22, a throttle 30 is disposed in the relief line 22 downstream of the multiple-position valve 21'. By means of this rpm-dependent switchover of the multiple-position valve 21', it is attained that at a corresponding control position of the expansible-substance governor 26 the pressure takes a course first according to curve II in FIG. 2, and then, beyond a predetermined rpm, specifically at the switchover of the multiple-position valve 21', takes a course as shown by curve I.

A pressure maintenance valve 31 with a relatively low inherent pressure is disposed in the outflow line 20 downstream of the multiple-position valve 21'. This pressure maintenance valve 31 operates with a barometer chamber or box 32, by way of which the inherent pressure is variable. This pressure maintenance valve 31 causes an additive variation of the pressure effecting the onset of injection, for instance in the form of curve III in FIG. 3, as a result of which an adjustment of the injection onset takes place in the direction of "early".

In the fifth exemplary embodiment shown in FIG. 4, in contrast to the foregoing embodiments, the control line 29' branches off from the relief channel 22 before the pressure maintenance valve 23. As a result, the throttle 30 mentioned in the previous embodiment can be blocked, and a very precise, rpm-dependent adjustment of the slide 27 takes place. A further difference is that a control valve, for instance a magnetic valve 33, is disposed parallel to the pressure maintenance valve 31' in the outflow line 20. The action of the pressure maintenance valve 31' can be intentionally shut OFF or turned ON by means of this magnetic valve 33.

In FIG. 5, the last-named circuit is illustrated constructively embodied. The pressure maintenance valve 31'' is disposed in the valve block 34 in which the outflow line 20 leads to a valve seat 35, which cooperates with a movable valve element 36, which is disposed on an armature 37 of a magnet 38. The pressure maintenance valve 31'' has its seat on a conical step of a transverse bore 40 in the body 34, whose ends each have a larger diameter in order to receive a connector nipple 41. A ball 42 acts as the movable valve element which is pressed by a spring 43 onto the seat 39 and is supported at the rear on a step 45 in the other connector nipple 41'. A connection 46 is provided from the interior of the magnetic valve 38 to the spring chamber of the pressure maintenance valve 31'', and this connection enables a virtually unthrottled outflow of the fuel when the magnetic valve 38 is opened. Because of the compact structure, this combination of pressure maintenance valve and magnetic valve can be combined in a modular fashion with the injection pump, with a minimum of manufacturing expense.

In FIG. 6, a spring 47 is disposed, as the seventh exemplary embodiment, between the expansible-substance governor 26 and the slide 27 of the multiple-position valve 21'. In contrast to the fifth and the fourth exemplary embodiments, the slide is as a result not adjusted indirectly and automatically; instead, only a force acting in the effective direction is varied, in other words, the force of the spring 47 is varied. Depending upon the control position of the expansible-substance governor 26, the control location 48 on the slide 27 acts as a throttle for the relief channel 22, so that as a result an earlier switchover of the multiple-position valve 21' can be effected when the control line 29, as shown in the fourth exemplary embodiment of FIG. 3, branches off from the relief channel 22 downstream of the pressure maintenance valve 23.

In FIG. 7 a plot diagram is given in which, as in FIG. 2, the stroke of the injection adjusting piston or the pressure "b" is plotted over the rpm. Curve IV in broken lines, showing the adjustment toward "early" effected by the pressure maintenance valve 23, terminates "earlier" or "later", depending upon the initial stress of the spring 47, in an rpm-dependent manner in accordance with the vertical lines V, in order to revert from the adjustment toward "early" back to the normal curve I.

In the eighth exemplary embodiment shown in FIG. 8, the slide 27 of the multiple-position valve 21''', in its outset position, rests on an annular shoulder 50, which reduces the surface of the slide 27 correspondingly exposed to the fuel pressure. The pressure necessary for lifting the slide 27 from the seat 50 is accordingly higher than the pressure required for further displacement.

This has the effect that the slide 27 lifts abruptly from the seat and is rapidly displaced into its terminal position. In FIG. 7, the corresponding course of events is represented by curve VI. The adjustment toward "early" terminates beyond a predetermined rpm $n_3$ in an abrupt fashion, up to the pressure determined by the pressure control valve 11 for this rpm.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal engines comprising:

an adjusting piston which is adjustable for the purpose of adjusting the onset of fuel injection;

said adjusting piston including a work chamber on one end and a restoring force chamber on its other end;

a suction chamber;

a flow passage between said suction chamber and said work chamber;

a pressure control valve;

said pressure control valve including a pressure chamber and a restoring chamber and a control piston which separates said pressure chamber in said pressure control valve from said restoring chamber in said pressure control valve;

said pressure control valve including an outflow cross-section which is controlled by said control piston;

a supply pump;

means supplying fluid from said supply pump into said suction chamber and said pressure chamber of said pressure control valve in proportion to rpm which fluid pressure acts on said adjusting piston counter to a restoring force and applies pressure on said control piston for determining an outflow cross section of said outflow cross-section of said pressure control valve for applying a restoring force on said adjusting piston;

a throttle in said control piston connection between the pressure chamber of said pressure control valve and said restoring chamber of said pressure control valve;

an outflow control valve operable in dependence of engine adjusting variable;

an outflow channel from the restoring chamber of said pressure control valve connected with said outflow control valve;

a relief channel including a pressure maintenance control valve means disposed parallel to the pressure control valve and connected to the means for supplying fluid to said pressure chamber of said pressure control valve and to said outflow control valve for control of fluid from said restoring force chamber of said pressure control valve and from said pressure maintenance control valve means.

2. A fuel injection pump in accordance with claim 1, wherein said outflow control valve is a multiple-position valve which controls both the relief channel and the outflow channel in a switching mode.

3. A fuel injection pump as defined by claim 2, wherein the multiple-position valve is embodied as a 4/2-way valve or a 3/2-way valve and is actuatable by means of an adjusting element functioning in accordance with engine variables used for influencing its operation.

4. A fuel injection pump as defined by claim 2, wherein means functioning in accordance with and responsive to temperature is the adjusting variable.

5. A fuel injection pump is defined by claim 2 wherein said multiple-position valve includes a slide and said slide is hydraulically actuatable by the pressure prevailing in the relief channel.

6. A fuel injection pump as defined by claim 5, wherein the actuation pressure is withdrawn upstream of the pressure maintenance valve means from the relief channel.

7. A fuel injection pump as defined by claim 5, wherein the actuation pressure is withdrawn between the pressure maintenance valve means and the multiple-position valve and that a throttle is disposed in the relief channel downstream of the multiple-position valve.

8. A fuel injection pump as defined by claim 5, 6, or 7, wherein a spring additionally engages the slide on the side which is exposed to hydraulic pressure, the initial stress of the spring being variable by means of said adjusting element.

9. A fuel injection pump as defined by claim 5, 6 or 7, wherein the end face on the slide which is exposed to pressure is enlarged at the beginning of the stroke.

10. A fuel injection pump as defined by claim 1, wherein pressure valve means is disposed in the outflow channel.

11. A fuel injection pump as defined by claim 9, wherein established pressure of pressure valve means is variable by means of an adjusting element functioning in accordance with engine variables influencing operation.

12. A fuel injection pump as defined by claim 1, wherein a pressure maintenance valve and a multiple-position valve are disposed in parallel partial channels in the outflow channel.

13. A fuel injection pump as defined by claim 11, wherein the pressure maintenance valve means and the closing valve are combined into one structural unit.

* * * * *